US006004105A

United States Patent [19]

Reynolds

[11] Patent Number: 6,004,105

[45] Date of Patent: Dec. 21, 1999

[54] DIAPHRAGM PUMP WITH ADJUSTABLE STROKE LENGTH

[75] Inventor: Steven M. Reynolds, Lucas, Ohio

[73] Assignee: Warren Rupp, Inc., Mansfield, Ohio

[21] Appl. No.: 09/027,729

[22] Filed: Feb. 23, 1998

[51] Int. Cl.[6] ..... F04B 19/24

[52] U.S. Cl. ..... 417/53; 417/386; 417/387; 417/393; 417/395; 417/439; 92/100

[58] Field of Search ..... 417/53, 386, 387, 417/393, 395, 439; 92/100

[56] References Cited

U.S. PATENT DOCUMENTS

| | | | |
|---|---|---|---|
| 3,838,946 | 10/1974 | Schall | 417/395 |
| 4,381,180 | 4/1983 | Sell | 417/393 |
| 4,416,599 | 11/1983 | Longchamp | 417/386 |
| 4,594,059 | 6/1986 | Becker | 417/439 |
| 4,773,831 | 9/1988 | Brauer et al. | 417/387 |
| 5,707,219 | 1/1998 | Powers | 417/386 |
| 5,724,881 | 3/1998 | Reynolds | 92/100 |
| 5,816,778 | 10/1998 | Elsey et al. | 417/46 |

*Primary Examiner*—Mark Paschall
*Assistant Examiner*—Leonid Fastovsky
*Attorney, Agent, or Firm*—Hill & Simpson

[57] ABSTRACT

A fluid powered diaphragm pump with an adjustable stroke is provided. The stroke of the pump is adjusted by providing an inner diaphragm plate assembly that includes a retractable piston. The piston is biased towards the inner plate by one or more standoffs that attach the piston to the plate. The bias of the piston is overcome by pressurized fluid that is communicated to a chamber defined by the piston and the inner plate. The fluid may be communicated to the chamber through the diaphragm rod. The inner diaphragm plate assemblies of both diaphragm chambers may be connected to different pressurized fluid supplies there enabling the stroke or capacity of the two diaphragm chambers to be controlled independently. As a result, the stroke or capacity of the two diaphragm chambers may differ.

24 Claims, 3 Drawing Sheets

DIAPHRAGM PUMP WITH ADJUSTABLE STROKE LENGTH

FIELD OF THE INVENTION

The present invention relates generally to fluid powered diaphragm pumps. More specifically, the present invention relates to fluid powered diaphragm pumps with a means for adjusting the stroke length of the pumps.

BACKGROUND OF THE INVENTION

Fluid powered diaphragm pumps are known. However, in currently available fluid powered diaphragm pumps, the stroke of the pump is fixed and defined by the construction of the pump. When it becomes necessary to adjust or change the stroke of a diaphragm pump, the pump must be disassembled and modified.

It is often necessary to change the stroke of a diaphragm pump. For example, if it is desired to transfer a defined volume such as 525 gallons with a diaphragm pump that has fixed displacement of 0.325 gallons per stroke, the required 525 gallon volume cannot be accurately displaced because the strokes required is not a whole number (525/0.325= 1615.385). In the above example, setting the stroke count at 1615 results in a displacement of too little liquid; setting the stroke count at 1616 results in the displacement of too much liquid. Thus, to produce the desired volume of 525 gallons in 1615 strokes, the pump displacement must be adjusted to 0.32508 (0.3250774) gallons per stroke. In order to accomplish this in a currently available fluid powered diaphragm pump, the pump must be disassembled and modified.

One such way to modify the pump is to disassemble the pump and thicken or use a thicker inner diaphragm plate. The inner diaphragm plate effects the length of the stroke because in many currently available designs, it is the inner diaphragm plate that contacts the pilot valve actuator. Thus, by using a thicker inner diaphragm plate, the pump stroke is shortened; by using a thinner diaphragm plate, the pump stroke is lengthened. However, this strategy is extremely inconvenient as it requires a major disassembly of the pump.

Further, when changing the pump stroke for the first time, the operator must often undergo a cumbersome trial and error process. That is, the pump must be disassembled, the thickness of the inner diaphragm plate changed, the pump reassembled, and tested so that the pump stroke can be accurately measured. Often, the pump must fine tuned by adding or subtracting the shim. Thus, the disassembly and reassembly of the pump in order to achieve the desired stroke displacement require a substantial amount of labor and down time.

The demand for adjusting the stroke length of diaphragm pumps is increasing. For example, a diaphragm pump may be used to pump ink to a printing head in a separate diaphragm pump used to scavenge the ink that is not consumed in the printing process. In order to simplify the installation and operation of the system, it may be required that both pumps be the same basic construction and run from a common controlled air supply. Further, it is typical to require the scavenger pump to pump more than the ink supply pump to prevent an overflow situation. Accordingly, in this situation, it would be convenient to easily shorten the stroke length of the supply pump while using the optimum or maximum flow rate for the scavenger pump.

Another application involves the use of a dual ported design with a single diaphragm pump. Specifically, each pump discharge chamber may be equipped with its own suction and discharge porting. Effectively, two single acting pumps are created from one diaphragm pump assembly. When this design is employed, it is often necessary to modify the stroke length of one or both of the diaphragm chambers. Specifically, if one side of the pump acts as a supply pump and the other side acts as a scavenger pump, it would be necessary to increase the thickness of the inner diaphragm plate of the ink supply pump side in order to ensure that the scavenger pump side is pumping at a greater capacity than the ink supply pump side.

Accordingly, there is a need for an improved fluid power diaphragm pump which the stroke length of one or both of the diaphragm chambers can be easily modified. Further, there is a need for an improved fluid powered diaphragm pump where the stroke length can be modified during operation of the pump. Still further, there is a need for a fluid powered diaphragm pump whereby the stroke length of one or more of the diaphragm chambers can be modified without disassembly of the pump.

SUMMARY OF THE INVENTION

The present invention satisfies the afore-noted needs by providing an improved diaphragm pump that comprises an inner diaphragm plate having a front side and a rear side. The rear side of the inner diaphragm plate comprises a recessed area that slidably accommodates a piston. The piston also comprises a front side that is accommodated in the recess of the inner plate and a rear side that engages a pilot valve actuator at the end of a stroke of the pump. The piston is connected to the inner plate by at least one spring biased standoff. The standoff biases the piston towards the recess of the inner plate.

The front side of the piston and the recess of the inner plate define a chamber. The chamber is in communication with a pressurized fluid supply. When pressurized fluid is supplied to the chamber, fluid pressure in the chamber overcomes the bias of the standoff spring and moves the piston partially out of the recess of the inner plate thereby expanding the size of the chamber. As a result, the rear side of the piston moves closer to the pilot valve thereby shortening the stroke of the pump.

In an embodiment, the pump further comprises a diaphragm rod that is connected to the inner diaphragm plate. The rod comprises a passageway extending through at least a portion of the rod. The passageway of the rod writes communication between the pressurized fluid supply and the chamber defined by the recess of the inner plate and the front side of the piston.

In an embodiment, the diaphragm rod slidably passes through the piston.

In an embodiment, the standoff comprises a front end that is threadably connected to the inner plate and a rear end that is connected to a retainer. The retainer engages a spring that is trapped between the retainer and the rear side of the piston. The spring biases the piston towards the rear end of the inner plate.

In an embodiment, the standoff slidably passes through the piston.

In an embodiment, a seal is disposed between the piston and the inner plate to seal the chamber and an additional seal is disposed between the rod and the piston to also seal the chamber.

In an embodiment, the passageway of the rod is in communication with the pressurized fluid supply. The passageway extends axially through the rod and the rod further includes at least one port by a communication between the passageway and the chamber.

In an embodiment, the rod passes through a sealing gasket disposed between the piston and the pressurized fluid supply.

In an embodiment, the rod is accommodate in a bore disposed in the central body with the pump with a clearance disposed between the rod and the body. The rod further includes at least one second port that is in communication with the clearance and the clearance is in communication with the pressurized fluid supply.

In an embodiment, the central body of the pump comprises a passageway is in communication with the pressurized fluid supply.

In an embodiment, at least three standoffs are used to spring-biasly connect the piston to the inner plate.

In an embodiment, an expandable chamber is provided at both inner diaphragm plates.

In an embodiment, an expandable chamber is provided at both inner diaphragm plates, both chambers are in communication with the same pressurized fluid supply.

In an embodiment, an expandable chamber is provided at both inner diaphragm plates, each expandable chamber being in communication with a different pressurized fluid supply and each pressurized fluid supply be maintained at an adjustable pressure so that the stroke for each diaphragm chamber can be adjusted independently of one another.

In an embodiment, the present invention provides a method of adjusting the stroke of a diaphragm pump by providing a diaphragm pump made in accordance with the present invention as set forth above and by providing pressurized fluid from a pressurized fluid supply to a chamber defined by the inner diaphragm plate and a piston. By adding additional fluid to the chamber and causing the piston to move at least partially out of the recess of the piston, the stroke of the pump is shortened.

In an embodiment, the present invention provides a method of independently adjusting the strokes of both diaphragm chambers of a single fluid power diaphragm pump. The method includes the step of providing a fluid powered diaphragm pump with expandable chambers disposed in each of its inner diaphragm plates. Each chamber is in communication with a separate pressurized fluid supply. Pressurized fluid from each pressurized fluid supply is communicated to its respective chamber independently thereby enabling the operator to shorten the stroke of each diaphragm chamber independently. Accordingly, a single fluid powered diaphragm pump may have two diaphragm chambers, each with a different capacity.

It is therefore an advantage of the present invention to provide a method of adjusting the stroke of a fluid powered diaphragm pump without disassembling the pump.

Another advantage of the present invention is that it provides a method of adjusting the stroke or pump capacity of a fluid powered diaphragm pump without disassembling the pump and during operation of the pump.

Another advantage of the present invention is that it provides a method of adjusting the stroke or capacities of the two diaphragm chambers of a fluid powered diaphragm pump independently so that each diaphragm chamber will have a different stroke capacity.

Still another advantage of the present invention is that it provides a fluid powered diaphragm pump having a pumping capacity that may be adjusted without disassembling the pump.

Another advantage of the present invention is that it provides a fluid powered diaphragm pump with a capacity that may be adjusted during operation of the pump.

Yet another advantage of the present invention is that it provides a fluid powered diaphragm pump with two chambers that may be adjusted so that each chamber has a different capacity, all without disassembling the pump.

Other objects and advantages of the present invention will become apparent upon reading the following detailed description, appended claims, and upon reference to the accompanying drawings.

BRIEF DESCRIPTION OF THE DRAWINGS

For a more complete understanding of the present invention, reference should now be made to the embodiments illustrated in greater detail in the accompanying drawings and described below by way of an example of the invention.

In the drawings.

From the above description it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

DESCRIPTION OF THE PRESENTLY PREFERRED EMBODIMENTS

Figure 1:
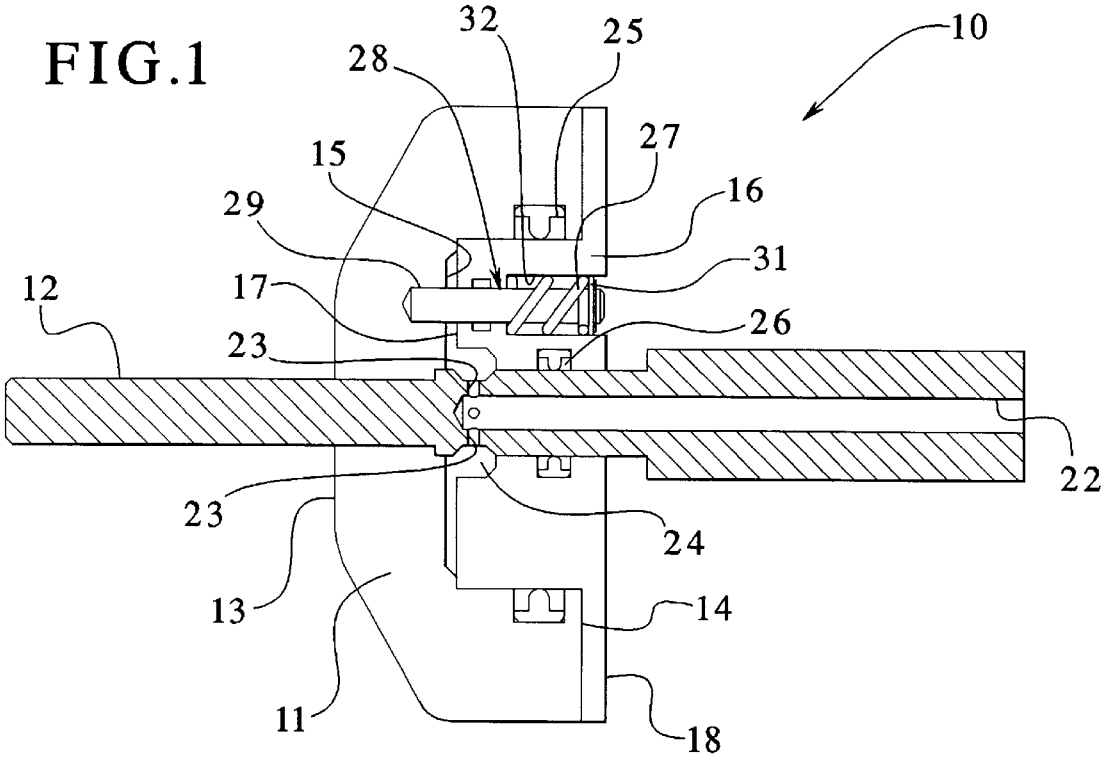
FIG. 1 is a sectional view of a diaphragm plate assembly made in accordance with the present invention, in a closed position.

Turning first to FIG. 1, an inner diaphragm plate assembly 10 is illustrated. In the assembly 10, an inner diaphragm plate 11 is connected to a diaphragm rod 12. The inner plate 11 includes a front side 13 that engages a diaphragm 14 (not shown at FIG. 1; see FIGS. 3–6) and a rear side 14 that includes a recess 15 for accommodating a piston 16. The piston 16 also includes a front side 17 and a rear side 18. The rear side 18 of the piston 16 engages a pilot valve actuator 21 (not shown at FIG. 1 see FIGS. 3–6). Because the position of the inner plate 11 is fixed on the rod 12 by way of a threaded or other suitable connection, movement of the piston 16, and specifically the rear side 18 of the piston 16, with respect to the inner plate 11 either shortens or lengthens the stroke of the pump. This shortening or lengthening of the stroke of the pump is accomplished by way of pressurized fluid communicated through the passageway 22 that extends axially through the rod 12. At a distal end of the passageway 22, ports 23 are provided which establish communication between the passageway 22 in the chamber 24 which is defined by the front side of the piston 17 and the rear side of the inner plate 11. The chamber 24 is expandable as shown in FIG. 2.

Returning to FIG. 1, communication of a pressurized fluid through the passageway 22, through the ports 23 and into the chamber 24 causes an increase in pressure in the chamber 24. This pressure is maintained by the seals shown at 25, 26. After the pressure in the chamber 24 reaches a level sufficient to overcome the bias of the spring 27, the piston 16 is moved rearwardly away from the inner plate 11 as shown in FIG. 2. The piston 16 is attached to the inner plate 11 by a spring-bias standoff 28. Preferably, three spring-bias standoffs like those shown at 28 are utilized. The standoff 28 includes a shaft 29 which is connected to the inner plate 11. The shaft 29 also accommodates a retainer 31 which traps the spring 27 between the retainer 31 and the piston 16 or, more specifically, between the retainer 31 and the bottom of the bore 32 in which the standoff 28 is accommodated.

Figure 2:
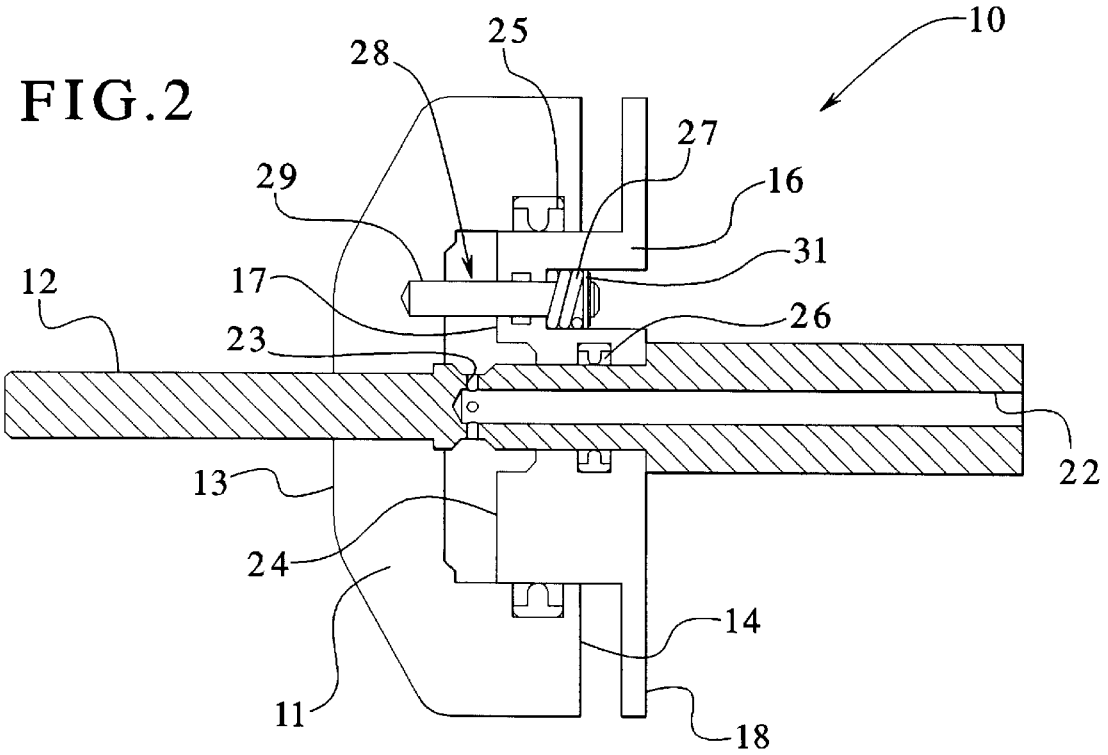
FIG. 2 is a sectional view of the diaphragm plate assembly shown in FIG. 1, in a partially-open position.

Accordingly, as shown at FIG. 2, when the pressure inside the chamber 24 reaches a sufficient level, the bias of the spring 27 is overcome and the piston 16 moves rearwardly as shown which results in a shortening of the pump stroke. The shortening or adjustment of the pump stroke is further illustrated in FIGS. 3–6.

Figure 3:
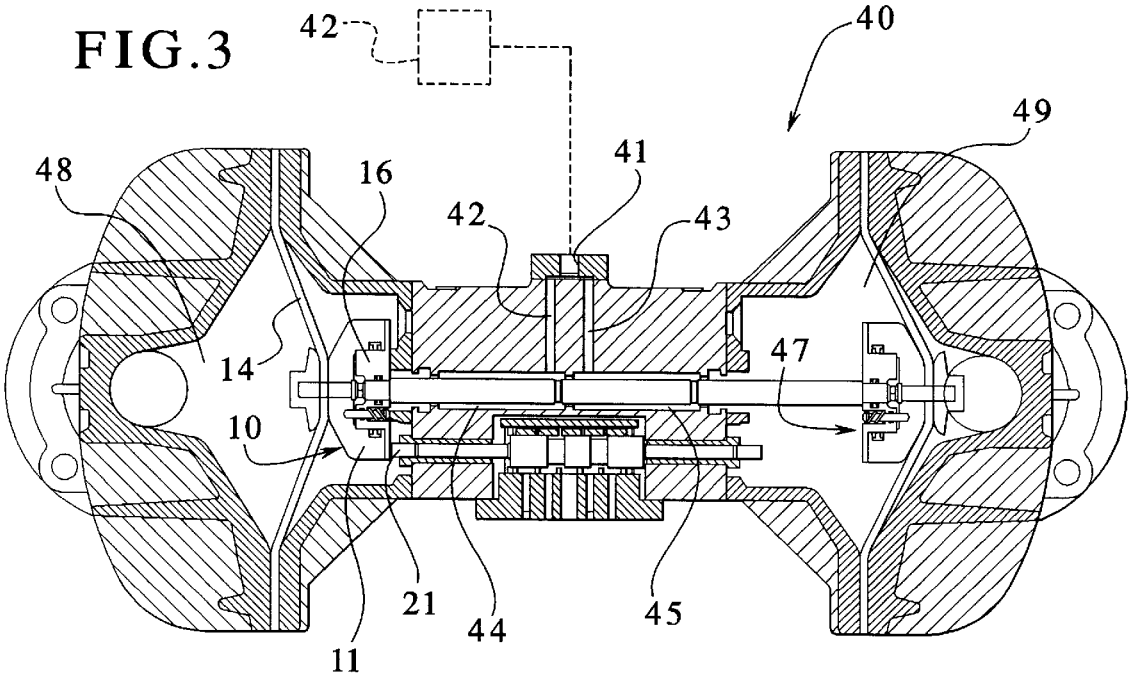
FIG. 3 is a cross-sectional view of a pump assembly made in accordance with the present invention, particularly illustrating an embodiment equipped to handle a single source of pressurized fluid for adjusting the stroke length of both diaphragm chambers.
Figure 4:
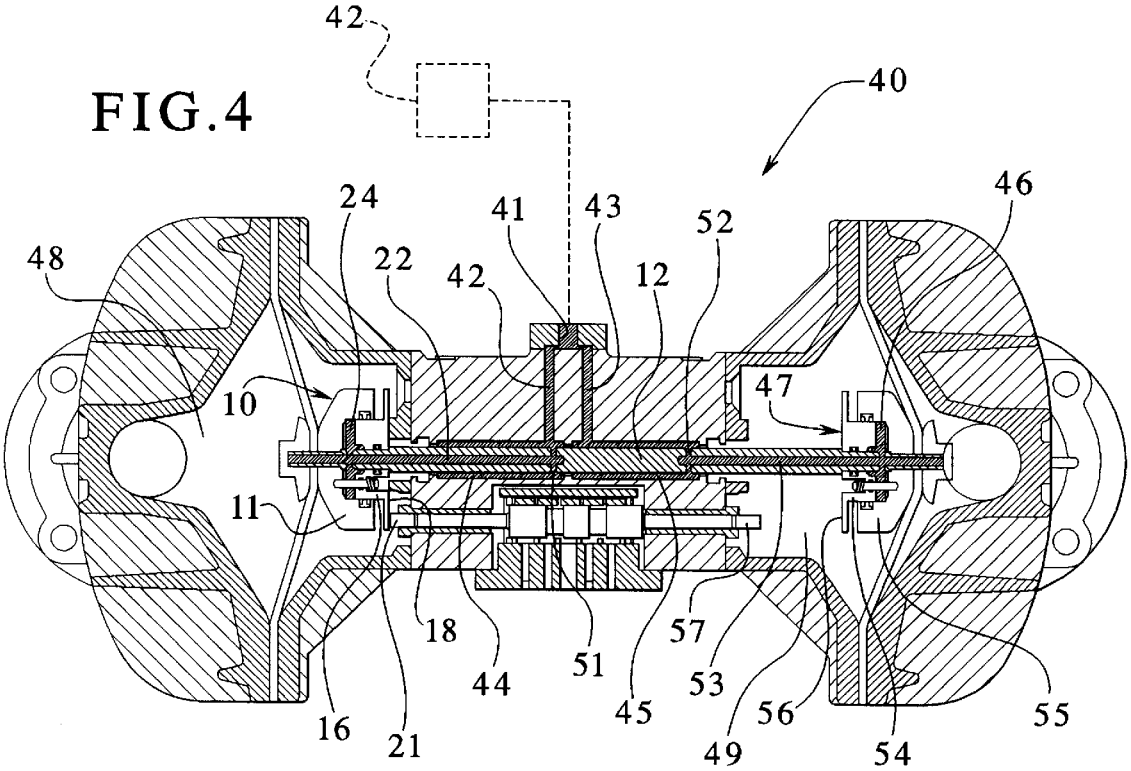
FIG. 4 is another cross-sectional view of the pump assembly shown in FIG. 3, particularly illustrating the passages for communicating pressurized air to the expandable chambers disposed between the inner diaphragm plates and the pistons accommodated therein.

Turning to FIG. 3, a cross-section of a pump assembly 40 is illustrated which is equipped with an inlet 41 connected to a pressurized fluid supply shown schematically at 42. Pressurized fluid is provided through the port 41, through the conduits 42, 43 and into the clearances shown at 44, 45. As shown in FIG. 4 below, the clearance 44 is in communication with the left chamber 24 and the clearance 45 is in communication with the right chamber 46. Still referring to FIG. 3, both the inner diaphragm plate assembly 10 and inner diaphragm plate assembly 47 are in a closed position. In the position shown at FIG. 3, the capacity of the pump 40 is at a maximum with respect to both diaphragm chambers 48, 49.

In the event it is desired to shorten the stroke or reduce the capacity of the diaphragm chambers 48, 49, pressurized fluid is supplied through the port 41, through the passageway 42 and into the clearance 44. Fluid is then communicated from the clearance 44 through the port 51 disposed in the rod 12 which provides communication to the clearance 44 and the passageway 22. Fluid then travels down the passageway 22 and into the chamber 24 as shown. Similarly, with respect to the right side of the pump 40, fluid is communicated through the port 41, into the passage 43 before entering the clearance 45. At least one port 52 is provided in the rod 12 which establishes communication between the clearance 45 and the second passage 53. Fluid then proceeds through the second passage 53 into the chamber 46 of the second inner diaphragm plate assembly 47 as shown. Both pistons 16, 54 are spaced apart from their respective inner plates 11, 55. As a result, the rear sides 18, 56 reach their respective pilot valve actuators 21, 57 before they would if they were in the closed position as shown in FIG. 3. As a result, the stroke of each diaphragm chamber 48, 49 is shortened or, the capacity is reduced.

In the embodiment illustrated in FIG. 4, the first passageway 22 and second passageway 53 of the rod 12 are isolated from one another. A simpler design would involve a single passageway extending through the rod 12. If a design like the one shown at FIG. 4 is employed, it may be desirable to provide fluid at differing pressures to the different inner plate diaphragm assemblies, 10, 47 as shown at FIGS. 5 and 6.

Figure 5:
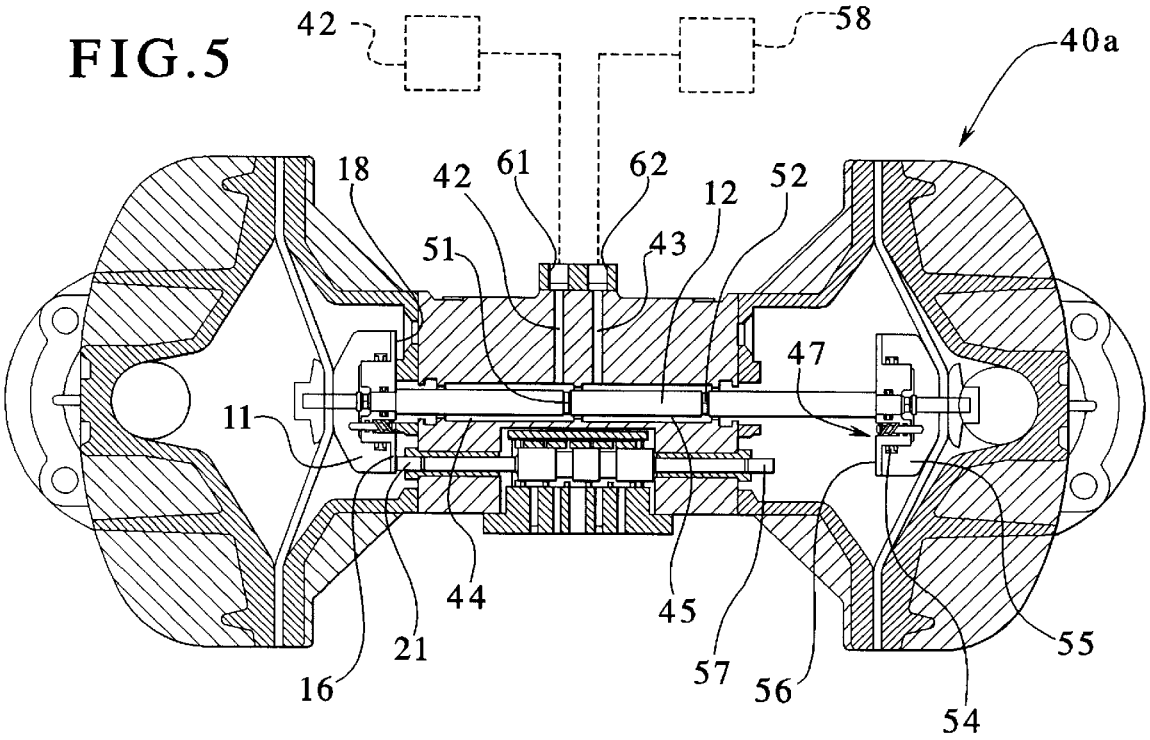
FIG. 5 is a sectional view of a pump assembly with an alternative embodiment that is equipped to be connected to a separate pressurized fluid source for each side of the pump.
Figure 6:
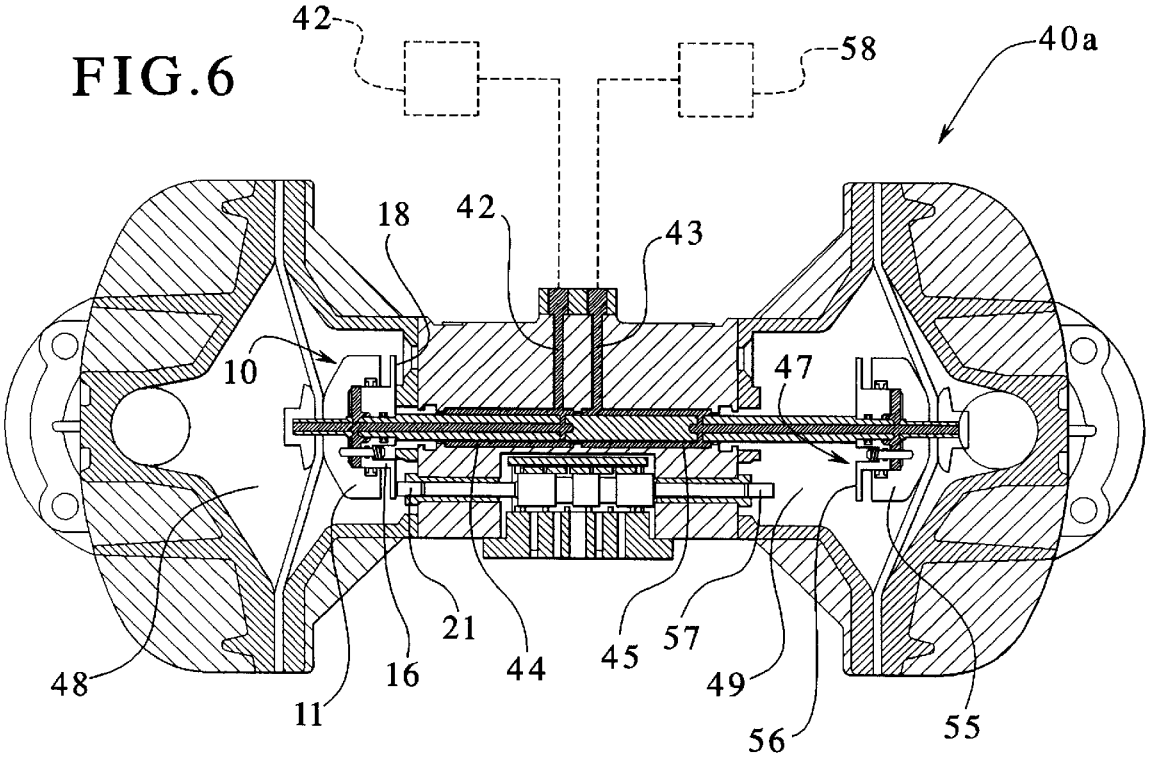
FIG. 6 is another section view of the pump assembly shown in FIG. 5, particularly illustrating the two pistons in different positions thereby providing different stroke lengths for each side of the pump.

Turning to FIG. 5, in addition to a first pressurized fluid supply 42, a second pressurized fluid supply 58 is provided. The two fluid supplies 42, 58 may be provided at the same or differing pressure. The first pressurized fluid supply is connected to a port 61 while the second pressurized fluid supply is connected to a port 62. The remaining elements of the pump assembly 40*a* shown in FIG. 5 are the same as those for the pump assembly 40 shown at FIGS. 3 and 4 and will not be described again. However, as shown in FIG. 6, the pressurized fluid supplies 42, 58 may be regulated at different pressures to thereby adjust the strokes of the inner plate assemblies 10, 47 differently. Specifically, as shown at FIG. 6, the first pressurized fluid supply 42 is regulated at a higher pressure than that of the second pressurized fluid supply 58 because, as shown in FIG. 6, the piston 16 is moved off of the inner plate 11 by a greater distance than the piston 54 from the inner plate 55. In this manner, the strokes or capacities of the chambers 48, 49 will be different. In the particular embodiment illustrated in FIGS. 5 and 6, the chamber 48 may be used to supply ink and the chamber 49 may be used to scavenge the ink. Of course, other applications will be apparent to those skilled in the art.

Further, it will be noted that the pressure of the fluid supplied by the pressurized fluid supplies 42, 58 may also be regulated or adjusted during the operation of the pump. Thus, the stroke of the diaphragm chambers 48, 49 may be adjusted during operation of the pumps 40, 40*a*.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

What is claimed:

1. A diaphragm pump with an adjustable stroke length, the pump comprising:

an inner plate comprising a recessed area that slidably accommodates a piston, the piston comprising a front side accommodated in the recess of the inner plate, the piston further comprising a rear side that engages a pilot valve actuator at the end of a stroke of the pump, the front side of the piston and the recess of the inner plate defining a chamber, the chamber being in communication with a pressurized fluid supply, wherein pressurized fluid supplied to the chamber causing the chamber to expand, the front side of piston to move partially out of the recess of the inner plate and the rear side of the piston to move towards the actuator thereby shortening the stroke of the pump.

2. The pump of claim 1 wherein the piston is connected to the inner plate by at least one spring biased standoff, the standoff biasing the piston toward the recess of the inner plate.

3. The pump of claim 1 further comprising a diaphragm rod connected to the inner diaphragm plate, the rod comprising a passageway extending through at least a portion of the rod.

4. The pump of claim 2 wherein the rod slidably passes through the piston.

5. The pump of claim 2 wherein the standoff comprises a front end that is connected to the inner plate and a rear end that is connected to a retainer, the retainer engaging a spring that is trapped between the retainer and the rear side of the piston, the spring biasing the piston towards the rear end of the inner plate, the standoff slidably passing through the piston.

6. The pump of claim 1 further comprising a first seal disposed between the piston and the inner plate to preclude fluid leakage from the chamber.

7. The pump of claim 3 wherein the passageway of the rod is in communication with the pressurized fluid supply, the passageway extends axially through the rod, the rod further comprising at least one port providing communication between the passageway and the chamber.

8. The pump of claim 7 wherein the rod passes through a sealing gasket disposed between the piston and the pressurized fluid supply.

9. The pump of claim 8 wherein the rod is accommodated in a bore disposed in a central body with a clearance disposed between the rod and the body, at least one second port providing fluid communication between the passageway and the pressurized fluid supply, the second port being in communication with the clearance, the clearance being in communication with the pressurized fluid supply.

10. The pump of claim 9 wherein the body comprises a passageway that is in communication with the pressurized fluid supply.

11. The pump of claim 2 wherein the at least one standoff comprises three standoffs.

12. A diaphragm pump with and adjustable stroke length, the pump comprising:

a diaphragm rod comprising first and second opposing ends, the first opposing end being connected to a first inner plate, the second opposing end being connected to a second inner plate, the rod comprising a first passageway extending through at least a portion of the rod towards the first end thereof and a second passageway extending through at least a portion of the rod towards the second end thereof, the first inner plate comprising a front side connected to the first end of the rod and a rear side comprising a recessed area that slidably accommodates a first piston, the first piston comprising a front side accommodated in the recess of the first inner plate, the first piston further comprising a rear side that engages a first actuator at the end of a first stroke of the pump, the first piston being connected to the first inner plate by at least one first spring-biased standoff, the first standoff biasing the first piston towards the rear end of the first inner plate, the front side of the first piston and the recess of the first inner plate defining a first chamber, the first passageway in the rod providing communication between the first chamber and a pressurized fluid supply, wherein pressurized fluid supplied to the first chamber causing the first chamber to expand, the front side of first piston to move away from the recess of the first inner plate and the rear side of the first piston to move towards the first actuator thereby shortening the stroke of the pump, the second inner plate comprising a front side connected to the second end of the rod and a rear side comprising a recessed area that slidably accommodates a second piston, the second piston comprising a front side accommodated in the recess of the second inner plate, the second piston further comprising a rear side that engages a second actuator at the end of a second stroke of the pump, the second piston being connected to the second inner plate by at least one spring-biased second standoff, the second standoff biasing the second piston towards the rear end of the second inner plate, the front side of the second piston and the recess of the second inner plate defining a second chamber, the second passageway in the rod providing communication between the second chamber and a pressurized fluid supply, wherein pressurized fluid supplied to the second chamber causing the second chamber to expand, the front side of second piston to move away from the recess of the second inner plate and the rear side of the second piston to move towards the second actuator thereby shortening the stroke of the pump.

13. The pump of claim 12 further comprising a first seal disposed between the first piston and the first inner plate, a second seal disposed between the second piston and the second inner plate, the seals precluding fluid leakage from the first and second chambers.

14. The pump of claim 12 wherein the first passageway extends axially through the rod between the first chamber and a middle section of the rod, the rod further comprising at least one port providing communication between the first passageway and the first chamber and at least one second port providing fluid communication between the first passageway and the pressurized fluid supply, and the second passageway extends axially through the rod between the second chamber and a middle section of the rod, the rod further comprising at least one port providing communication between the second passageway and the second chamber and at least one third port providing fluid communication between the second passageway and the pressurized fluid supply.

15. The pump of claim 12 wherein the first and second passageways are connected and extend axially through the rod between the first and second chambers, the rod further comprising at least one port providing communication between the first passageway and the first chamber, at least one port providing communication between the second passageway and the second chamber, and at least one second port providing fluid communication between the first and second passageways and the pressurized fluid supply.

16. The pump of claim 12 wherein the pressurized fluid supply comprises a first pressurized fluid supply in communication with the first passageway for supplying fluid to the first chamber at a first pressure and a second pressurized fluid supply in communication with the second fluid passageway for supplying fluid to the second chamber at a second pressure.

17. The pump of claim 16 wherein the first passageway extends axially through the rod between the first chamber and a middle section of the rod, the rod further comprising at least one port providing communication between the first passageway and the first chamber and at least one second port providing fluid communication between the first passageway and the first pressurized fluid supply, and the second passageway extends axially through the rod between the second chamber and a middle section of the rod, the rod further comprising at least one port providing communication between the second passageway and the second chamber and at least one third port providing fluid communication between the second passageway and the second pressurized fluid supply.

18. The pump of claim 12 wherein the rod passes through a first sealing gasket disposed between the first piston and the pressurized fluid supply and the rod also passes through a second sealing gasket disposed between the second piston and the pressurized fluid supply.

19. The pump of claim 14 wherein the rod is accommodated in a bore disposed in a central body, the rod further comprising a first section disposed between the middle section and the first end, the first passageway extending through the first section, the rod further comprising a second section disposed between the middle section and the second end, the second passageway extending through the second section, the pump further comprising a first clearance disposed between the first section of the rod and the body and a second clearance disposed between the second section of the rod and the body, the at least one second port being in communication with the first clearance, the at least one third port being in communication with the second clearance, the first and second clearances being in communication with the pressurized fluid supply.

20. The pump of claim 17 wherein the rod is accommodated in a bore disposed in a central body, the rod further comprising a first section disposed between the middle section and the first end, the first passageway extending through the first section, the rod further comprising a second section disposed between the middle section and the second end, the second passageway extending through the second section, the pump further comprising a first clearance disposed between the first section of the rod and the body and a second clearance disposed between the second section of the rod and the body, the at least one second port being in communication with the first clearance, the at least one third port being in communication with the second clearance, the first clearance being in communication with the first pressurized fluid supply, the second clearance being in communication with the second pressurized fluid supply.

21. The pump of claim 15 wherein the rod is accommodated in a bore disposed in a central body with a clearance disposed between the rod and the body, the at least one second port being in communication with the clearance, the clearance being in communication with the pressurized fluid supply.

22. A diaphragm pump with and adjustable stroke length, the pump comprising:

a first pressurized fluid supply at a first pressure and second pressurized fluid supply at a second pressure, a diaphragm rod comprising first and second opposing ends and a middle section, the rod further comprising a first section disposed between the first end and the middle section and a second section disposed between the second end and the middle section, the first pressurized fluid supply being in communication with a first section of the rod, the second pressurized fluid supply being in communication with the second section of the rod, the first end of the rod being connected to a first inner plate, the second end of the rod being connected to a second inner plate, the rod comprising a first passageway extending through the first section of the rod towards the first end thereof and a second passageway extending through the second section of the rod towards the second end thereof, the first inner plate comprising a front side connected to the first end of the rod and a rear side comprising a recessed area that slidably accommodates a first piston, the first piston comprising a front side accommodated in the recess of the first inner plate, the first piston further comprising a rear side that engages a first pilot valve actuator at the end of a first stroke of the pump, the first piston being connected to the first inner plate by at least one spring-biased first standoff, the first standoff biasing the first piston towards the rear end of the first inner plate, the first standoff slidably passing through the first piston, the front side of the first piston and the recess of the first inner plate defining a first chamber, the first passageway in the rod providing communication between the first chamber and the first pressurized fluid supply, wherein pressurized fluid supplied to the first chamber from the first pressurized fluid supply causing the first chamber to expand and the rear side of the first piston to move towards the first pilot valve actuator thereby shortening the stroke of the pump, the second inner plate comprising a front side connected to the second end of the rod and a rear side comprising a recessed area that slidably accommodates a second piston, the rod slidably passing through the second piston, the second piston comprising a front side accommodated in the recess of the second inner plate, the second piston further comprising a rear side that engages a second pilot valve actuator at the end of a second stroke of the pump, the second piston being connected to the second inner plate by at least one spring-biased second standoff, the second standoff biasing the second piston towards the rear end of the second inner plate, the second standoff slidably passing through the second piston, the front side of the second piston and the recess of the second inner plate defining a second chamber, the second passageway in the rod providing communication between the second chamber and a pressurized fluid supply, wherein pressurized fluid supplied to the second chamber from the second pressurized fluid supply causing the second chamber to expand and the rear side of the second piston to move towards the second pilot valve actuator thereby shortening the stroke of the pump.

23. A method of adjusting a stroke length of a diaphragm pump, the method comprising the following steps:

providing an inner plate comprising a front side, a rear side comprising a recessed area that slidably accommodates a piston, the piston comprising a front side accommodated in the recess of the inner plate, the piston further comprising a rear side that engages a pilot valve actuator at the end of a stroke of the pump, the piston being connected to the inner plate by at least one spring-biased standoff, the front side of the piston and the recess of the inner plate defining a chamber, the passageway in the rod providing communication between the chamber and a pressurized fluid supply, introducing pressurized fluid from the pressurized fluid supply, through the passageway and into the first chamber thereby expanding the first chamber and shortening the stroke of the pump, regulating the amount of fluid contained in the chamber to adjust the stroke of the pump.

24. A method of adjusting a stroke length of a diaphragm pump, the method comprising the following steps:

providing a first pressurized fluid supply at a first pressure and second pressurized fluid supply at a second pressure, a first inner plate comprising a front side connected to the first end of the rod and a rear side comprising a recessed area that slidably accommodates a first piston, the rod slidably passing through the first piston, the first piston comprising a front side accommodated in the recess of the first inner plate, the first piston further comprising a rear side that engages a first pilot valve actuator at the end of a first stroke of the pump, the first piston being connected to the first inner plate by at least one spring-biased first standoff, the first standoff biasing the first piston towards the rear end of the first inner plate, the front side of the first piston and the recess of the first inner plate defining a first chamber, the first chamber being in communication with the first pressurized fluid supply, a second inner plate comprising a front side connected to the second end of the rod and a rear side comprising a recessed area that slidably accommodates a second piston, the rod slidably passing through the second piston, the second piston comprising a front side accommodated in the recess of the second inner plate, the second piston further comprising a rear side that engages a second pilot valve actuator at the end of a second stroke of the pump, the second piston being connected to the second inner plate by at least one spring-biased second standoff, the second standoff biasing the second piston towards the rear end of the second inner plate, the second standoff slidably passing through the second piston, the front side of the second piston and the recess of the second inner plate defining a second chamber, the second passageway in the rod providing communication between the second chamber and a pressurized fluid supply, introducing pressurized fluid to the first chamber from the first pressurized fluid supply causing the first chamber to expand, the front side of first piston to move away from the recess of the first inner plate and the rear side of the first piston to move towards the first pilot valve actuator thereby shortening the stroke of the pump, regulating the amount of fluid in the first chamber to adjust the spacing of the first piston from the recess to adjust the stroke of the pump, introducing pressurized fluid supplied to the second chamber from the second pressurized fluid supply causing the second chamber to expand, the front side of second piston to move away from the recess of the second inner plate and the rear side of the second piston to move towards the second pilot valve actuator thereby shortening the stroke of the pump, regulating the amount of fluid in the first chamber to adjust the spacing of the first piston from the recess to adjust the stroke of the pump.

* * * * *